US011193289B2

(12) United States Patent
Ocegueda et al.

(10) Patent No.: US 11,193,289 B2
(45) **Date of Patent: *Dec. 7, 2021**

(54) THREADED ATTACHMENT SYSTEM FOR WALL-MOUNTED POOL SKIMMER

(71) Applicant: POLYGROUP MACAU LIMITED (BVI), Tortola (VG)

(72) Inventors: Victor Ocegueda, Baja California (MX); Yifeng Zhang, Xinxiang (CN)

(73) Assignee: Polygroup Macau Limited (BVI), British (VG)

( * ) Notice: Subject to any disclaimer, the term of this patent is extended or adjusted under 35 U.S.C. 154(b) by 0 days.

This patent is subject to a terminal disclaimer.

(21) Appl. No.: 16/553,767

(22) Filed: Aug. 28, 2019

(65) Prior Publication Data

US 2019/0383049 A1 Dec. 19, 2019

Related U.S. Application Data

(63) Continuation of application No. 14/946,910, filed on Nov. 20, 2015, now Pat. No. 10,400,465.

(60) Provisional application No. 62/083,955, filed on Nov. 25, 2014.

(51) Int. Cl.
*E04H 4/12* (2006.01)
*E04H 4/00* (2006.01)

(52) U.S. Cl.
CPC ..... *E04H 4/1272* (2013.01); *E04H 4/0018* (2013.01); *E04H 4/1209* (2013.01)

(58) Field of Classification Search
CPC .... E04H 4/1209; E04H 4/1272; E04H 4/1245
See application file for complete search history.

(56) References Cited

U.S. PATENT DOCUMENTS

| | | | |
|---|---|---|---|
| 3,401,958 | A | 9/1968 | Demyon |
| 3,552,567 | A | 1/1971 | Arp |
| 3,839,750 | A | 10/1974 | Baker et al. |
| 4,179,038 | A | 12/1979 | Rosan, Jr. |
| 4,359,790 | A | 11/1982 | Chalberg |
| 4,426,286 | A | 1/1984 | Puckett et al. |
| 4,454,035 | A | 6/1984 | Stefan |
| 4,903,351 | A | 2/1990 | Dengel et al. |
| 2002/0178494 | A1 | 12/2002 | Marbach |
| 2008/0216877 | A1 | 9/2008 | Lawson |

FOREIGN PATENT DOCUMENTS

| | | | |
|---|---|---|---|
| CN | 201265265 | Y | 7/2009 |
| CN | 103657206 | A | 3/2014 |

*Primary Examiner* — Erin Deery
(74) *Attorney, Agent, or Firm* — Finnegan, Henderson, Farabow, Garrett & Dunner LLP

(57) ABSTRACT

The present disclosure is directed towards skimmer systems for above-ground pools. In particular, the present disclosure relates to skimmer systems that are easily installed to the side wall of an above-ground pool. In addition, aspects of the present disclosure relate to a skimmer system for an above-ground pool that provides for an improved watertight seal between the skimmer system and the side wall of the pool. Further, aspects of the present disclosure relate to a weir that is easily installed into and removed from a skimmer system according to a user's needs.

20 Claims, 6 Drawing Sheets

THREADED ATTACHMENT SYSTEM FOR WALL-MOUNTED POOL SKIMMER

CROSS REFERENCE TO RELATED APPLICATION

This application claims the benefit, under 35 U.S.C. § 120 to U.S. patent application Ser. No. 14/946,910 entitled "THREADED ATTACHMENT SYSTEM FOR WALL-MOUNTED POOL SKIMMER," filed 20 Nov. 2015, which claims benefit under 35 U.S.C. § 119(e), of U.S. Provisional Patent Application No. 62/083,955, filed 25 Nov. 2014, entitled "THREADED ATTACHMENT SYSTEM FOR WALL-MOUNTED POOL SKIMMER," the entire contents and substance of which is incorporated herein by reference in its entirety as if fully set forth below.

BACKGROUND OF THE INVENTION

1. Field of the Invention

Embodiments of the present disclosure relate to wall-mounted pool water skimmers for above-ground pools (AGPs) and, more particularly, to skimmers mounted by a thread-and-nut system. The present disclosure further relates to methods for attaching a pool water skimmer to a vertical wall of an AGP.

2. Background of the Art

Above-ground pools and cleaning systems for AGPs are known in the art. Typically, AGPs are constructed of steel, resin, plastic, or other materials. AGPs generally are constructed using a perimeter frame, of various designs, with a heavy plastic, vinyl, or fabric liner to contain water. Additionally, AGPs may be collapsible to enable convenient storage, and they may include portals. Typically, AGPs are constructed entirely above ground. So, in a typical configuration, a suitably level site is chosen, and the pool is assembled and filled in place.

Typically, AGPs include a skimmer system. Traditional wall-mounted skimmer systems for AGPs include a skimmer basket on one side of the vertical wall and a bracket placed on the other side of the wall such that the skimmer basket and bracket are joined through a hole in the vertical wall. Generally, the skimmer basket and bracket are attached to a vertical wall of the AGP with a number of screws, and they are sealed with one or more gaskets or seals. Accordingly, in a typical configuration, the vertical wall and the seals are sandwiched between the bracket and the skimmer basket, and the skimmer system is sealed through the compression provided by the screws. In various traditional skimmer systems, the intake to the skimmer is provided with a weir that allows solids (e.g., leaves, branches, pool toys, large insects) to enter the skimmer unit while preventing the solids from exiting the skimmer and going back into the pool.

But traditional skimmer systems are problematic. They are difficult and time-consuming to install because of the number of screws (or other fastening means) necessary to secure the skimmer basket and bracket to the vertical wall while creating a watertight seal. Further, the compression provided by the screws often fails to create a watertight seal as the force provided by the screws, which are dispersed apart from one another, is not uniform across the surface of the bracket, skimmer basket, or vertical wall.

Thus it would be desirable to develop an improved skimmer system for an above-ground pool that is easy and convenient to install, and that provides an improved watertight seal. It is to the foregoing that the present disclosure is primarily directed.

BRIEF DESCRIPTION OF THE DRAWINGS

Various features and advantages of the present disclosure may be more readily understood with reference to the following detailed description taken in conjunction with the accompanying drawing sheets.

DETAILED DESCRIPTION

The present disclosure can be understood more readily by reference to the following detailed description of exemplary embodiments and the examples included herein. Before the exemplary embodiments of the devices and methods according to the present disclosure are disclosed and described, it is to be understood that embodiments are not limited to those described within this disclosure. Numerous modifications and variations therein will be apparent to those skilled in the art and remain within the scope of the disclosure. It is also to be understood that the terminology used herein is for the purpose of describing specific embodiments only and is not intended to be limiting.

Unless otherwise noted, the terms used herein are to be understood according to conventional usage by those of ordinary skill in the relevant art. In addition to any definitions of terms provided below, it is to be understood that as used in the specification and in the claims, "a" or "an" can mean one or more, depending upon the context in which it is used.

Also, in describing the exemplary embodiments, terminology will be resorted to for the sake of clarity. It is intended that each term contemplates its broadest meaning as understood by those skilled in the art and includes all technical equivalents that operate in a similar manner to accomplish a similar purpose. As used herein, the term "pool" shall refer to and include any above ground or free-standing swimming pool, spa, water tank, or other above-ground liquid containment enclosure.

To facilitate an understanding of the principles and features of the embodiments of the present disclosure, exemplary embodiments are explained hereinafter with reference to their implementation in an illustrative embodiment. Such illustrative embodiments are not, however, intended to be limiting.

The materials described hereinafter as making up the various elements of the embodiments of the present disclosure are intended to be illustrative and not restrictive. Many suitable materials that would perform the same or a similar function as the materials described herein are intended to be embraced within the scope of the exemplary embodiments. Such other materials not described herein can include, but are not limited to, materials that are developed after the time of the development of the invention, for example.

Figure 1:
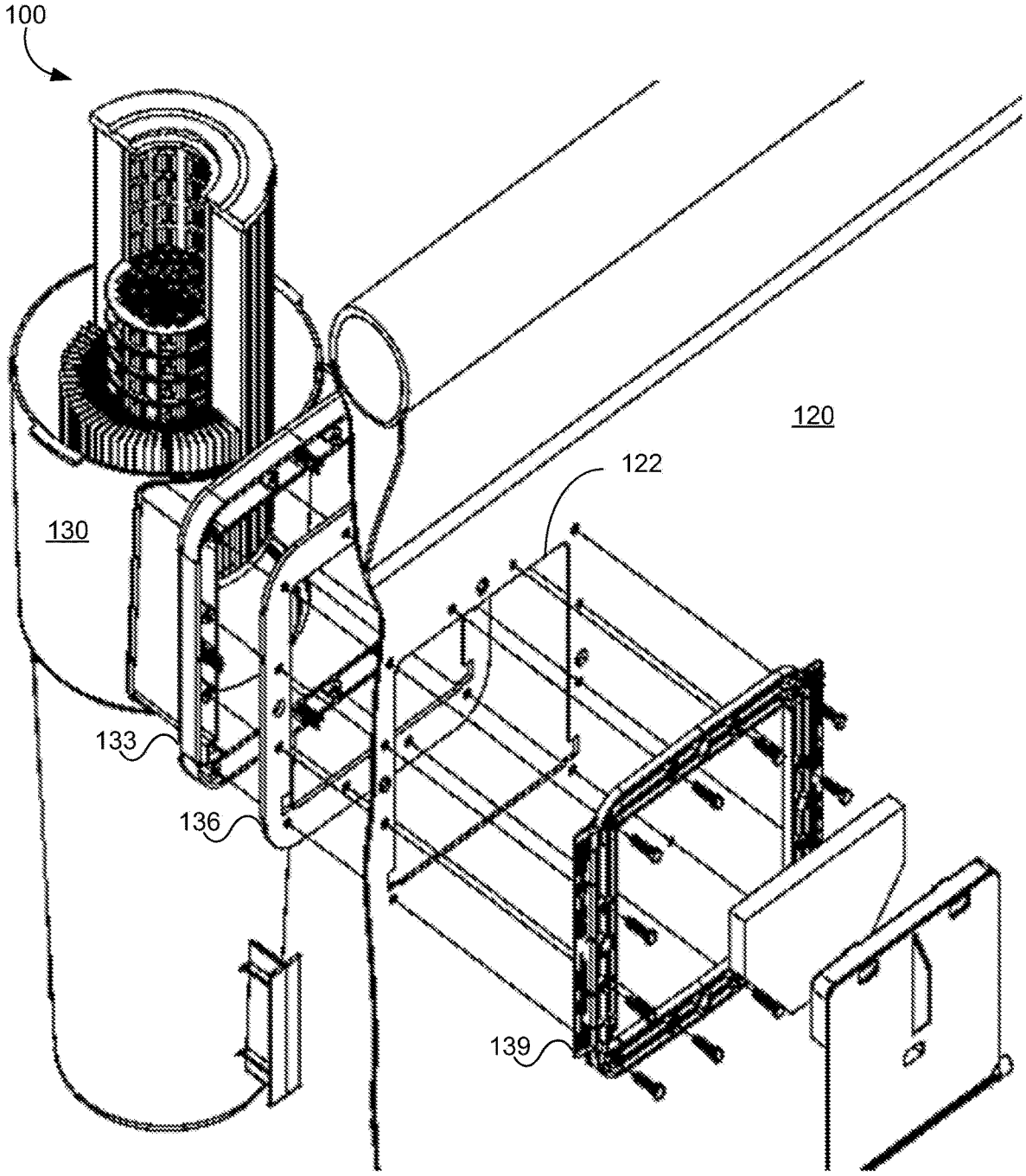
FIG. 1 PRIOR ART
FIG. 1 is an exploded view of a conventional skimmer system.

Referring now to the drawings, wherein like reference numerals represent like parts throughout, FIG. 1 is an example of a traditional wall-mounted skimmer system 100 for an above-ground pool (AGP). As shown in FIG. 1, a traditional wall-mounted skimmer system 100 generally attaches to and is supported by the side wall 120 of an AGP. As will be understood, the side wall 120 of the AGP can comprise an outer wall and an inner wall. Typically, the traditional wall-mounted skimmer system 100 includes a skimmer unit 130 having a flat intake bracket 133 that includes a plurality of screw holes configured to receive screws. Further, as shown in FIG. 1, the traditional wall-mounted skimmer system 100 includes a seal 136, which is typically installed between flat intake bracket 133 and a hole (or "opening") 122 in the side wall 120 on the outer wall of the side wall 120 of the AGP. Additionally, as shown in FIG. 1, the traditional wall-mounted skimmer system 100 includes a flat bracket 139, which is installed against the hole 122 in the side wall 120 on the inner wall of the side wall 120 of the AGP. As shown, the flat bracket 139, seal 136, and flat intake bracket 133 may be attached using a plurality of screws or other fastening means. As shown in FIG. 1, the vertical wall 122 and seal 136 are sandwiched between the flat intake bracket 133 and flat bracket 139, which creates a seal. But, as discussed previously, the seal may not be entirely watertight because, for example, the force exerted by the screws is not uniform across the boundary of the hole 122.

Four different containers upon which embodiments of the present disclosure (or traditional skimmer systems 100) can be installed are shown in the perspective views illustrated in FIGS. 2A-2D. As shown in FIGS. 2A-2D, an AGP 200 may have a base 210 and a side wall 120.

The AGP 200 can be a frame pool or a pop-up type of pool, both of which may be collapsible in nature. Generally, a frame pool is prefabricated and includes a plurality of external vertical braces or frames 260 for supporting the frame pool above the ground, as shown in FIGS. 2A and 2B. The frame pool can be made of metal, plastic, and other suitable materials. In some embodiments, the pop-up pool may be adapted to rise with the amount of water inserted into pool (e.g., FIG. 2C), and can also be outfitted with external braces or frames 260 for additional support (e.g., FIG. 2D).

Typically, an AGP 200 is formed with the base 210 and side wall 120. The base 210 and side wall 120 can be manufactured out of many different materials and can be formed of the same materials or each a different material. For example, a base 210 and a side wall 120 can be formed from a synthetic material such as, for example, plastic, polyurethane, PVC, nylon, or other synthetic material, or a base 210 and a side wall 120 can be formed from other suitable materials. Generally, the materials should be treated to retain water. For example, such materials could be adhered to, laminated with, coated with, or bonded to a material impermeable to water. In some embodiments, a base 210 can be formed from a nylon shell, which can be laminated or otherwise treated to hold water. Similarly, a wall 120 of an AGP 200 can be constructed from these materials, or other materials having similar suitable qualities. Many of the materials that are used are selected for their durability.

For example, a base 210 can be formed from materials that can be more durable than a side wall 120, as a base 210 may be subjected to more wear than that experienced by a side wall 120. Also, in some embodiments, a base 210 and a side wall 120 can be formed from a combination of materials, which can be adhered or bonded together. The materials used for the various portions of an AGP 200, including, for example, a base 210 and a side wall 120, can be joined (i.e., connected) by way of a number of commonly known suitable techniques, such as sewing, adhesives, bonding, lamination, RF welding, and other suitable joining techniques. The connection of a base 210 to a side wall 120 can be along the bottom 222 of the side wall 120, as shown in FIG. 2A. For example, a base 210 can include a perimeter, wherein a side wall 120 can be connected about the perimeter of the base 210 such that the side wall 120 is generally perpendicular to the base 210.

As discussed in relation to FIG. 1, a side wall 120 may have an inner wall and an outer wall. An inner wall can be sealable to the outer wall. Typically, a side wall 120 is non-inflatable. In some embodiments, an inner wall can be made of pliable material such as plastic (e.g., PVC), while an outer wall may be made of a rigid material such as hard plastic. Alternatively, in some embodiments, an inner wall may be made of a pliable plastic such as PVC, and an outer wall may be made from a metal such as steel or aluminum. Accordingly, in some embodiments, an inner wall can limit leakage of fluid should the outer wall crack. Likewise, the material of an inner wall can be made of hard plastic, and the material of an outer wall can be made of pliable material to protect from potential leakage should the hard plastic crack. In other embodiments, an inner and outer wall can be made of the same material. For example, the inner wall can be made of hard plastic, while the outer wall can also be made of hard plastic.

Figure 2C:
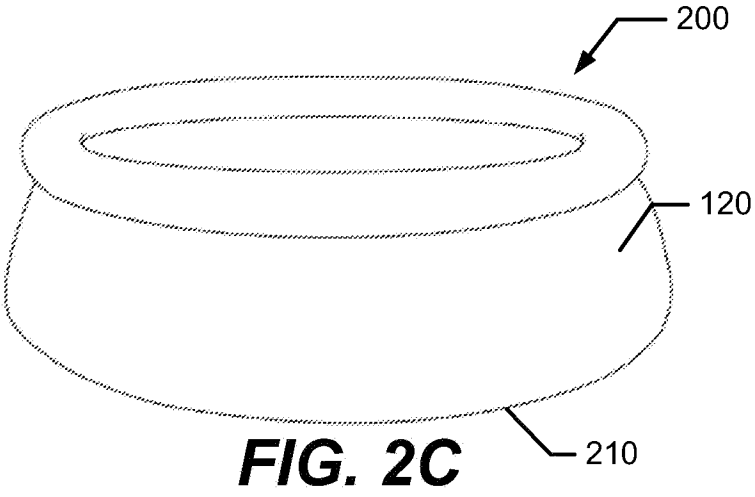
FIG. 2C is a perspective view of yet another above-ground container, specifically a ring swimming pool.
Figure 2D:
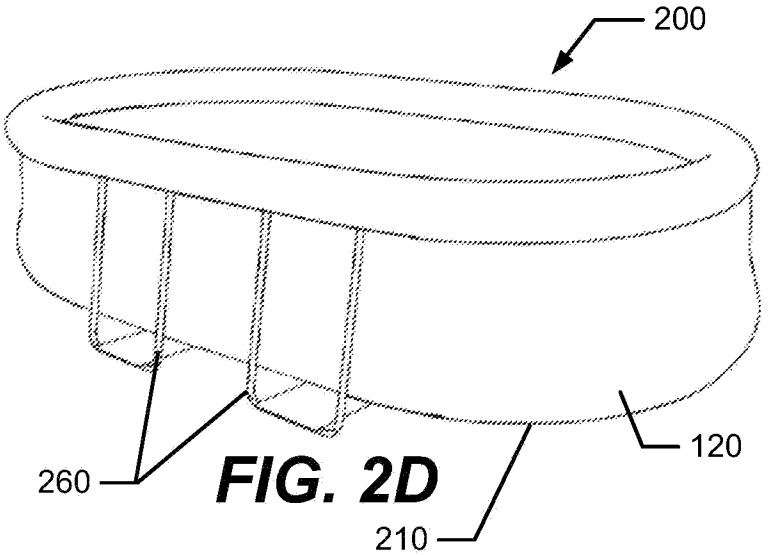
FIG. 2D is a perspective view of another above-ground container, specifically an oval swimming pool.
Figure 2A:
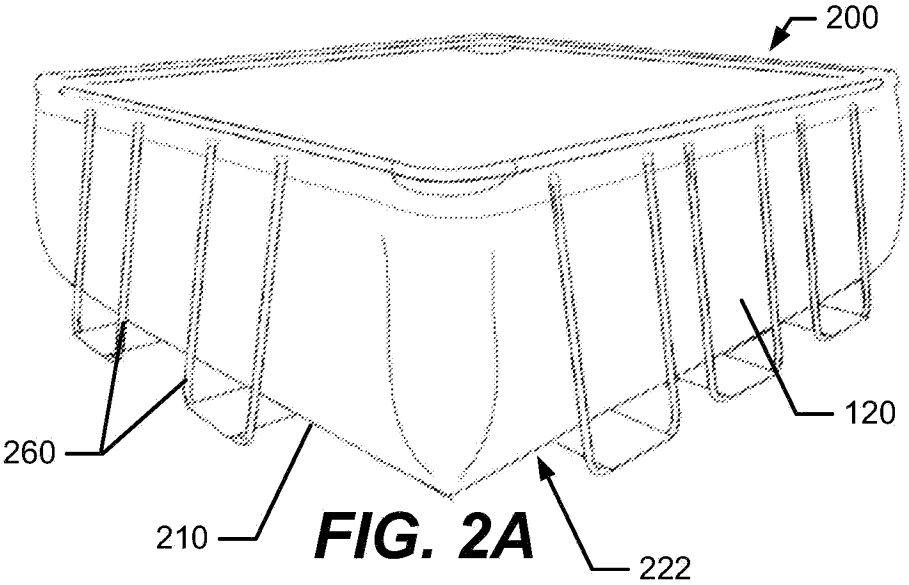
FIG. 2A is a perspective view of above-ground container, specifically a rectangular frame swimming pool.
Figure 2B:
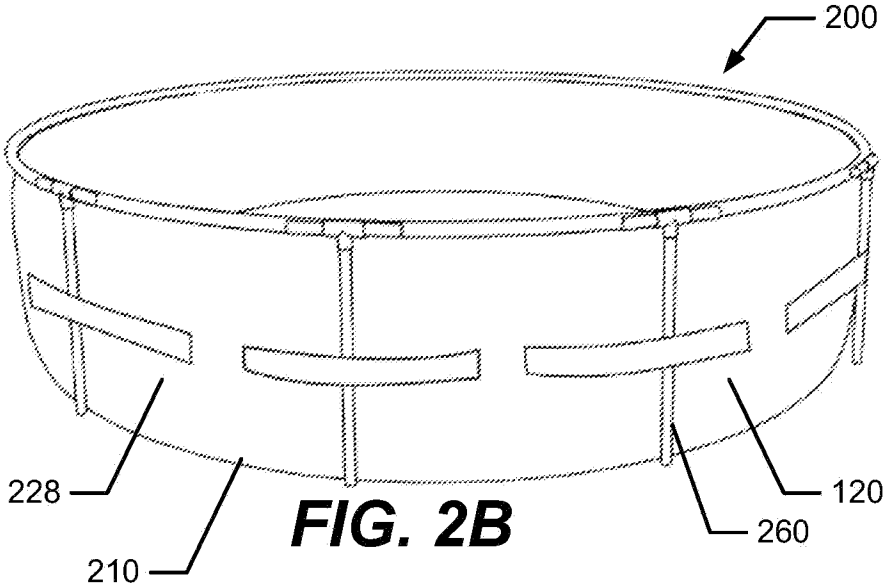
FIG. 2B is a perspective view of another above-ground container, specifically a round frame swimming pool.

In some embodiments, an AGP 200 may have one or more braces or structural support members 260, as is shown in FIGS. 2A, 2B, and 2D. A support member 260 can include vertical rib supports, and can be coupled proximate to a side wall 120 of an AGP 200. For example, one or more support members 260 can be inserted within the material making up a side wall 120 (e.g., into one or more pockets incorporated into a side wall 120). A support member 260 can have at least a portion coupled to the top of a side wall 120 and vertically along a side wall 120 to provide rigidity to a side wall 120.

Figure 3:
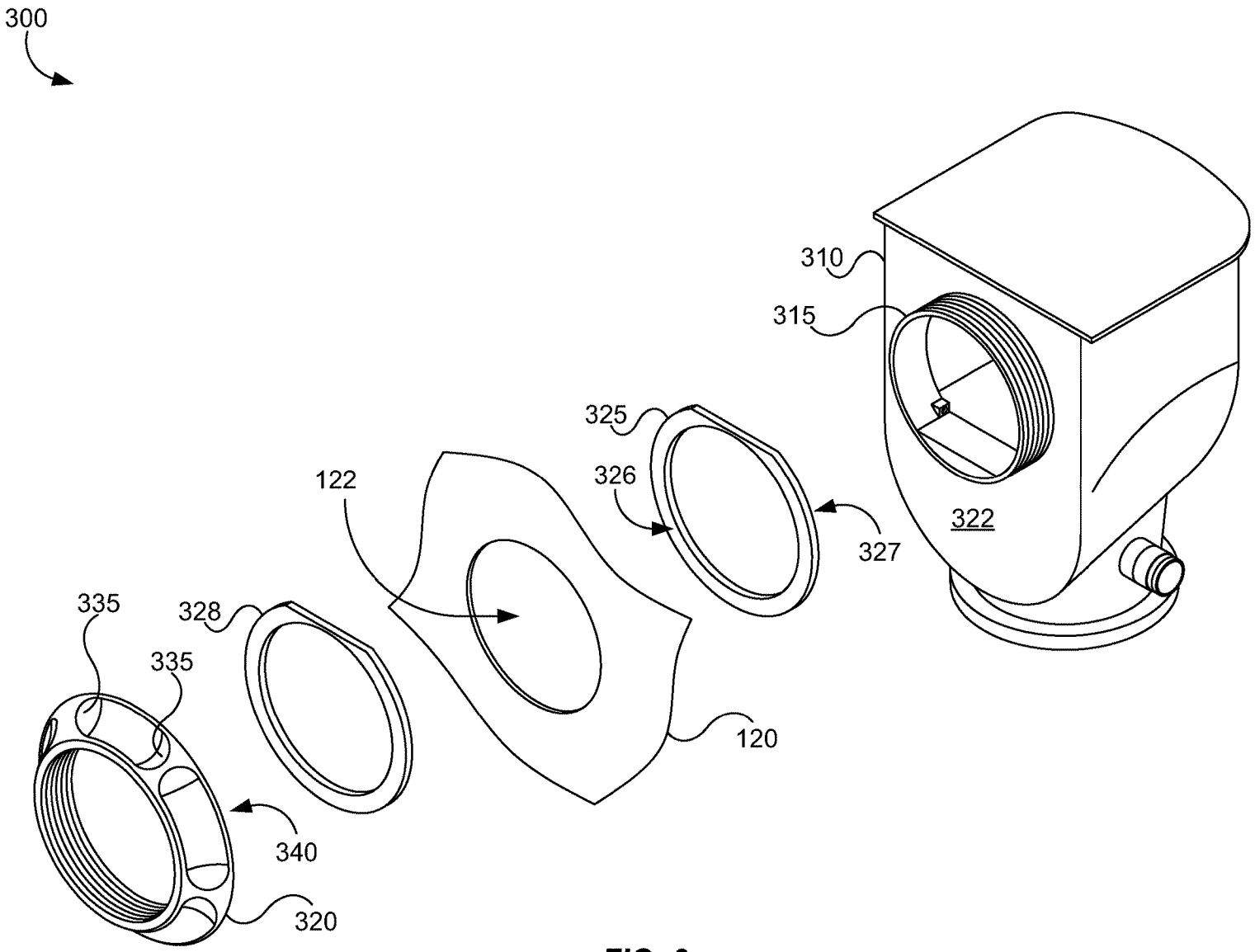
FIG. 3 is a perspective, exploded view of a skimmer system and pool wall, according to an exemplary embodiment of the present disclosure.

FIG. 3 shows an exemplary skimmer system 300 according to some embodiments of the present disclosure. According to some embodiments, and as shown in FIG. 3, a skimmer system 300 may comprise a skimmer unit 310, and may also comprise a pump unit (not shown). Further, a skimmer system 300 may comprise an intake 315, which may be circular and have a diameter, as shown in FIG. 3. In some embodiments, an intake 315 may be molded onto a front-facing panel 322 of a skimmer unit 310 and extend beyond the front-facing panel 322. In some embodiments, an intake 315 extending beyond a front-facing panel 322 can be inserted through an opening 122 in a side wall 120 of an AGP 200. Further, an intake 315 may be threaded such that a skimmer unit 310 can be secured to the side wall 120 of an AGP 200 with a skimmer unit securing nut 320.

As is shown in FIG. 3, in some embodiments, a skimmer system 300 may comprise a seal ring 325, which may be a gasket, having an inner surface 326 and an outer surface 327, and a diameter substantially similar to the diameter of an intake 315. In some embodiments, a seal ring 325 may be positioned around an intake 315 and may be sandwiched between the outer wall of a side wall 120 and a front-facing panel 322 of a skimmer unit 310 such that the outer surface 327 is disposed against the front-facing panel 322, and the inner surface 326 is disposed against the outer wall of the side wall 120. As will be appreciated, a seal ring 325 may assist in creating a watertight or near-watertight seal when a skimmer system 300 is installed to a side wall 120. Additionally, a skimmer system 300 may comprise additional seals or gaskets. For example, in some embodiments, a seal 328 may be positioned between a skimmer unit securing nut 320 and the inner wall of a side wall 120.

In example embodiments, the diameter of a skimmer unit securing nut 320 is substantially equal to the diameter of an intake 315. Accordingly, a skimmer unit securing nut 310 can be threaded onto an intake 315 to create a watertight seal or near-watertight seal (i.e., substantially watertight seal) between the skimmer system 300 and the side wall 110 of the AGP 200. In some embodiments, a watertight seal of a skimmer system 300 can be achieved by the exerted compression force provided by hand-tightening a skimmer unit securing nut 320 onto an intake 315. Accordingly, in some embodiments, a skimmer unit securing nut 320 may be configured with threads that allow for a user or installer to secure a skimmer unit securing nut 320 to an intake 315 using hand-tight force such that hand-tight force is sufficient to achieve a watertight or near-watertight seal between a skimmer system 300 and a side wall 110 when a skimmer unit securing nut 320, intake 315, skimmer unit 310, seal ring 325 (and any other seals or gaskets) are joined together. Typically, it is preferable that a skimmer unit securing nut 320 not be overtightened as overtightening can cause wrinkles in a side wall 120, which may ultimately compromise the integrity of a side wall 120.

In example embodiments, a skimmer unit securing nut 320 may be provided with surface features 335 that allow for a secure grip by a user or installer while securing a skimmer unit securing nut 320 onto an intake 315. As shown in FIG. 3, such surface features 335 may be embodied as raised or vertical surfaces upon which an installer can exert force with a thumb or finger when tightening or loosening a skimmer unit securing nut. Further, in some embodiments, a skimmer unit securing nut 320 may have a back surface 340 that can be provided with one or more shoulders positioned to exert force on the inside wall of the side wall 120 as the skimmer unit securing nut 320 is threaded onto the intake 315. As will be understood and appreciated, such shoulders may further assist in creating a watertight seal between a skimmer system 300 and a side wall 120 of an AGP 200.

Figure 4:
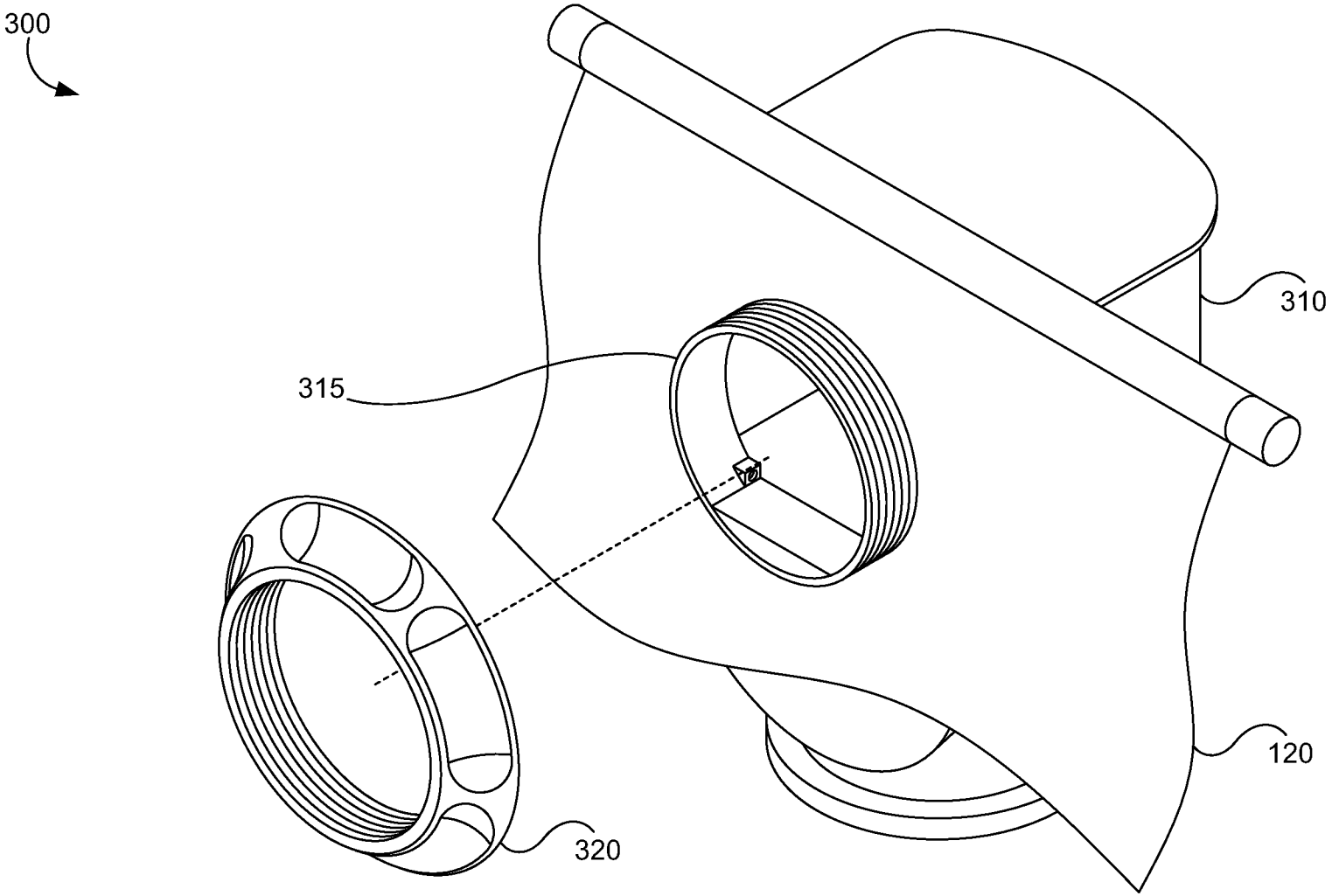
FIG. 4 is another exploded view of a skimmer system and pool wall, according to an exemplary embodiment of the present disclosure.

FIG. 4 shows an alternate view of an embodiment of a skimmer system 300 according to the present disclosure. As shown in FIG. 4, in some embodiments, an intake 315 of a skimmer unit 310 may be placed through a hole in a side wall 120 of an AGP 200. As discussed in relation to FIG. 3, a seal ring 325 or other gasket may be placed around the intake 315 such that the seal ring 325 is sandwiched between the outer wall of the side wall 120 and the body of the skimmer unit 310. Further, as shown in FIG. 4, in some embodiments, to secure a skimmer system 300 to a side wall 120 of an AGP 200, a skimmer unit securing nut 320 may be threaded onto an intake 315.

Figure 5:
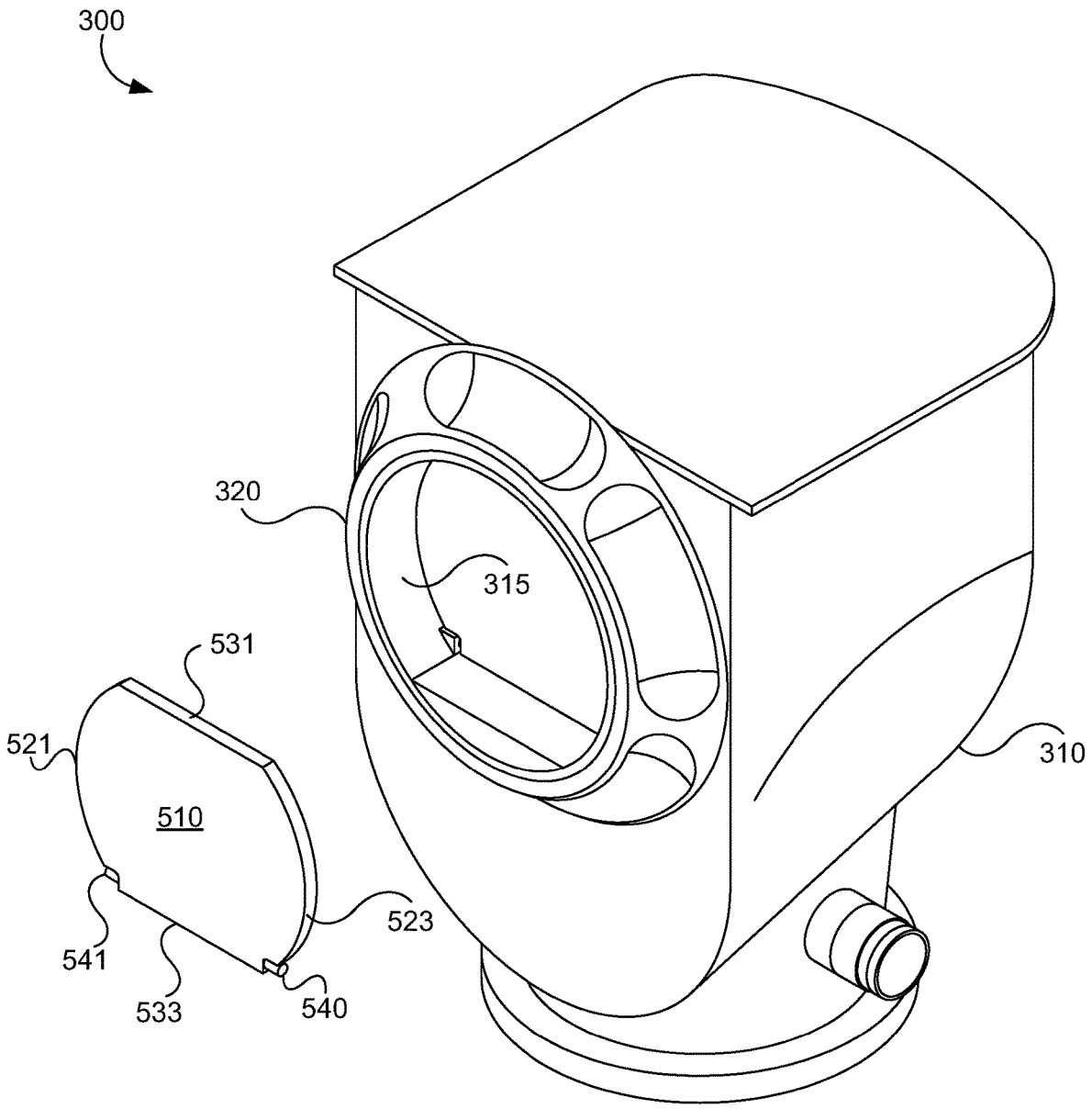
FIG. 5 is a perspective view of a skimmer system and a weir, according to an exemplary embodiment of the present disclosure.

FIG. 5 shows a view of a skimmer system 300 with a skimmer unit securing nut 320 threaded onto the intake 315, according to some embodiments. For explanation purposes, FIG. 5 does not show side wall 120, but it will be understood that when installed, side wall 120 is sandwiched between securing nut 320 and the front-facing panel 322 of skimmer body 310. Further, FIG. 5 shows a weir 510, which may be included in a skimmer system 300. As discussed, a weir 510 may be configured to allow water flow into a skimmer body 310 through an intake 315. Further, a weir 510 may be configured to prevent or limit water egress out of the skimmer body 310 and back through the intake 315 and into AGP 200. Accordingly, a weir 510 may allow solids such as leaves, sticks, toys, etc., from inside the AGP 200, to enter a skimmer unit 310, while also preventing the solids from exiting the skimmer unit 310 and returning to the inside of the AGP 200. As shown in FIG. 5, in some embodiments, a weir 510 may be four-sided. In some embodiments, two of the opposing sides (e.g., 521 and 523) may be curved such that the sides are substantially similar to the curvature of an intake 315. Further, in some embodiments, two of the opposing sides may be substantially flat. As shown in FIG. 5, in some embodiments, opposing flat sides may constitute a top edge 531 and bottom edge 533. Additionally, in some embodiments, a weir 510 may comprise a mechanical system for attaching the weir 510 to a skimmer unit 310. For example, as shown in FIG. 5, a weir 510 may comprise flexible pins 540, 541, which may be positioned at the corners of the bottom edge 533. In some embodiments, flexible pins 540, 541 are configured to allow flexibility when installing a weir 510 into a skimmer system 300. But pins 540, 541 should provide sufficient rigidity to prevent a weir 510 from detaching from an intake 315 as water and debris pass from the inside of the AGP 200 into the skimmer unit 310.

Figure 6:
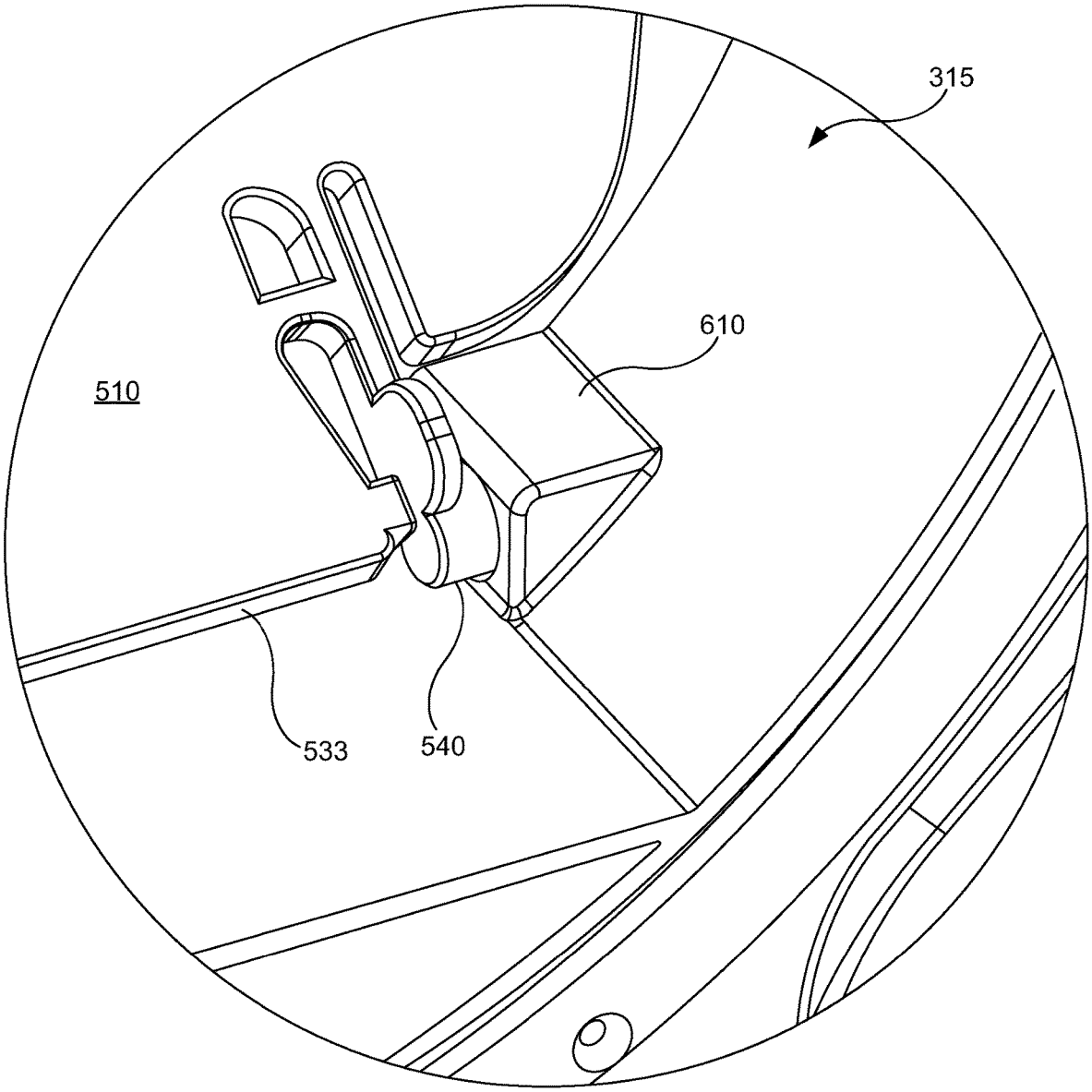
FIG. 6 is a close-up view of a skimmer system and weir, according to an exemplary embodiment of the present disclosure.

FIG. 6 shows a close-up view of a weir 510 and an intake 315. In some embodiments, an intake 315 may be provided with a system for securing a weir 510 to the intake 315. For example, as shown in FIG. 6, in example embodiments, an intake 315 may be provided with a female receiving bracket 610 for coupling a weir 500 to the intake 315 using a flexible pin 540. As will be understood, in some embodiments, pins 540, 541 may be constructed such that, when being installed or removed from a female receiving bracket 610, pins 540, 541 can flex from a first (i.e., neutral) position to a second inward position to clear the female receiving bracket 610 and then return to the first position where they each are held in place by a respective female receiving bracket 610. As will further be understood, while FIG. 6 shows a flexible pin 540 at one corner of a bottom edge 533 of a weir 510, in such embodiments, flexible pins 540, 541 are positioned at opposing corners of the bottom edge 533, and corresponding female receiving brackets (e.g., 610) are included with an intake 315. In some embodiments, in addition to coupling a weir 510 to an intake 315, receiving brackets (e.g., 610) may be configured to allow a weir to pivot. Accordingly, in some embodiments, a receiving bracket 610 may be configured to allow a weir 510 to open, such that water and debris can pass into a skimmer unit 310 from inside an AGP 200, and close, such that water and debris are prevented from egressing back into the AGP 200 from the skimmer unit 310. As will be understood and appreciated, such a configuration of flexible pins 540, 541 and receiving brackets (e.g., 610) allow for a detachable weir 510 that can be installed and removed according to a user's needs.

Numerous characteristics and advantages have been set forth in the foregoing description, together with details of structure and function. While various embodiments of the present disclosure have been presented, it will be apparent of those skilled in the art that many modifications, additions, and deletions, especially in matters of shape, size, and arrangement of parts, can be made therein without departing from the spirit and scope of the disclosure and its equivalents as set forth in the following claims. Therefore, other modifications or embodiments as may be suggested by the teachings herein are particularly reserved as they fall within the breadth and scope of the claims here appended.

What is claimed is:

1. A skimmer system comprising:

a skimmer unit having a front-facing panel and a threaded intake, the threaded intake having a diameter, and the threaded intake disposed on the front-facing panel and extending out from the front-facing panel such that the threaded intake is adapted to extend through a side wall of an above-ground pool;

a securing nut having a diameter substantially equal to the threaded intake diameter, the securing nut having a plurality of threads and adapted to be rotatably connected to the threaded intake; and a weir, comprising a bottom edge having a first end and a second end and attached to the front-facing panel;

wherein the skimmer system is configured to provide a watertight seal with the aboveground pool when (i) the threaded intake is extending through the side wall of the above-ground pool and (ii) the securing nut is rotatably connected to the threaded intake.

2. The skimmer system of claim 1, further comprising a seal ring having (i) a first surface, (ii) a second surface, and (iii) a diameter substantially equal to the intake diameter and adapted for placement around the intake, wherein, when the seal ring is disposed around the intake and the securing nut is rotatably connected to the threaded intake extending through the side wall of the above-ground pool, a first surface of the seal ring is disposed against the front-facing panel of the skimmer unit and a second surface of the seal ring is configured to be disposed against the side wall.

3. The skimmer system of claim 2, wherein the seal ring is a first seal ring, the system further comprising:

a second seal ring having (i) a first surface, (ii) a second surface, and (iii) a diameter substantially equal to the intake diameter and adapted for placement around the intake, wherein the first surface of the securing nut is configured to be disposed against the first surface of the second seal ring, and the second surface of the second seal ring is configured to be disposed against the side wall when the threaded intake is extending through the side wall of the above-ground pool and the second seal ring is disposed around the intake.

4. The skimmer system of claim 1, wherein the first end and the second end each have a flexible pin disposed thereon, each flexible pin configured for insertion into a first and a second female receiving bracket, respectively; and wherein the weir can rotate to and from an open and a closed position when the first flexible pin is inserted into the first female receiving bracket and the second flexible pin is inserted into the second female receiving bracket.

5. The skimmer system of claim 4, the first and second flexible pins being capable of flexing inward from a first position toward a second position and subsequently returning to the first position from the second position.

6. The skimmer system of claim 1, wherein the securing nut comprises a plurality of surface features configured to assist a user in tightening and/or loosening the securing nut.

7. The skimmer system of claim 6, wherein each of the plurality of surface features comprise a raised surface upon which a user can exert force with a thumb and/or finger when tightening and/or loosening the securing nut.

8. An above-ground pool comprising:

a base having a perimeter;

a side wall having a bottom edge and an opening, the side wall joined at the bottom edge to the base such that the side wall extends vertically upward from the base;

a skimmer system comprising:

a skimmer unit having a front-facing panel and a threaded intake, the threaded intake having a diameter, and the threaded intake disposed on the front-facing panel and extending out from the front-facing panel such that the threaded intake can extend through the opening of the side wall; and a securing nut having a diameter substantially equal to the threaded intake diameter, the securing nut having a plurality of threads and adapted to be rotatably connected to the threaded intake, a weir, comprising a bottom edge having a first end and a second end and attached to the front-facing panel, wherein, when the threaded intake is extending through the opening of the side wall and the securing nut is rotatably connected to the threaded intake, a first surface of the securing nut is proximate a first surface of the side wall, and the skimmer system provides a watertight seal with the side wall.

9. The above-ground pool of claim 8, wherein the base and the side wall are manufactured out of the same material.

10. The above-ground pool of claim 8, wherein the side wall comprises an inner wall and an outer wall, wherein the inner wall and the outer wall are constructed from the same material, and the inner wall is sealable to the outer wall.

11. The above-ground pool of claim 8, the skimmer system further comprising a seal ring having i) a first surface, (ii) a second surface, and (iii) a diameter substantially equal to the intake diameter and adapted for placement around the intake, wherein, when the seal ring is disposed round the intake and the securing nut is rotatably connected to the threaded intake extending through the side wall of the above-ground pool, a first surface of the seal ring is disposed against the front-facing panel of the skimmer unit and a second surface of the seal ring is disposed against a second surface of the side wall.

12. The above-ground pool of claim 11, wherein the seal ring is a first seal ring, the pool further comprising:

a second seal ring having (i) a first surface, (ii) a second surface, and (iii) a diameter substantially equal to the intake diameter and adapted for placement around the intake, wherein the first surface of the securing nut is configured to be disposed against the first surface of the second seal ring, and the second surface of the second seal ring is configured to be disposed against the first surface of the side wall when the threaded intake is extending through the side wall and the second seal ring is disposed around the intake.

13. The above-ground pool of claim 8, wherein the first end and the second end each have a flexible pin disposed thereon, each flexible pin configured for insertion into a first and a second female receiving bracket, respectively; and wherein the weir can rotate to and from an open and a closed position when the first flexible pin is inserted into the first female receiving bracket and the second flexible pin is inserted into the second female receiving bracket.

14. The above-ground pool of claim 8, wherein the securing nut comprises a plurality of surface features configured to assist a user in tightening and/or loosening the securing nut.

15. The above-ground pool of claim 14, wherein each of the plurality of surface features comprise a raised surface upon which a user can exert force with a thumb and/or finger when tightening and/or loosening the securing nut.

16. The above-ground pool of claim 8, wherein the side wall comprises an inner wall and an outer wall, wherein the inner wall is constructed from a pliable material and the outer wall is constructed from a rigid material, and the inner wall is sealable to the outer wall.

17. A method comprising:

assembling an above-ground pool having a base and a side wall joined to the base, the side wall having an opening;

extending a threaded intake disposed on a front-facing panel of a skimmer unit through the opening of the side wall;

inserting a first and a second flexible pin of a weir into a first receiving bracket and a second female receiving bracket, wherein, when the first flexible pin is inserted into the first female receiving bracket and the second flexible pin is inserted into the second female receiving bracket, the weir can rotate to and from open and closed positions;

rotatably connecting a securing nut to the threaded intake extending through the opening of the side wall, wherein, when the threaded intake is extending through the side wall of the above-ground pool and the securing nut is rotatably connected to the threaded intake, a first surface of the securing nut is proximate a first surface of the side wall, and the securing nut and the skimmer unit provide a watertight seal with the above-ground pool.

18. The method of claim 17, wherein the side wall comprises a plurality of pockets, and wherein assembling an above-ground pool comprises inserting a support member into each of the plurality of pockets.

19. The method of claim 17, wherein assembling the above-ground pool comprises filling the pool at least partially with water.

20. The method of claim 17, wherein the threaded intake comprises a bottom edge having the first receiving bracket disposed on a first side of the bottom edge and the second female receiving bracket disposed on a second side of the bottom edge, and wherein the first and second female brackets are attached to the front-facing panel of the skimmer unit.

* * * * *